US007699243B2

(12) United States Patent
Starke

(10) Patent No.: US 7,699,243 B2
(45) Date of Patent: Apr. 20, 2010

(54) APPLICATOR DEVICE FOR APPLYING LIQUID MATERIAL

(75) Inventor: Bernward Starke, Adendorf (DE)

(73) Assignee: Nordson Corporation, Westlake, OH (US)

( * ) Notice: Subject to any disclaimer, the term of this patent is extended or adjusted under 35 U.S.C. 154(b) by 216 days.

(21) Appl. No.: 11/872,317

(22) Filed: Oct. 15, 2007

(65) Prior Publication Data

US 2008/0135650 A1 Jun. 12, 2008

(30) Foreign Application Priority Data

Oct. 27, 2006 (DE) ..... 20 2006 016 674 U

(51) Int. Cl.
*B05B 1/24* (2006.01)

(52) U.S. Cl. ..... 239/135; 239/128; 239/390; 239/549; 239/597; 239/600; 425/186

(58) Field of Classification Search ..... 239/128, 239/135, 290, 296, 298, 390, 549, 566, 600; 425/7, 186, 188
See application file for complete search history.

(56) References Cited

U.S. PATENT DOCUMENTS

| | | | | |
|---|---|---|---|---|
| 5,292,068 | A * | 3/1994 | Raterman et al. | 239/135 |
| 5,524,828 | A | 6/1996 | Raterman et al. | |
| 5,636,790 | A * | 6/1997 | Brusko et al. | 239/390 |
| 5,740,963 | A | 4/1998 | Riney et al. | |
| 6,210,141 | B1 * | 4/2001 | Allen | 425/7 |
| 6,540,831 | B1 * | 4/2003 | Craine et al. | 239/298 |
| 6,676,038 | B2 * | 1/2004 | Gressett et al. | 239/296 |
| 7,399,361 | B2 * | 7/2008 | de Leeuw et al. | 239/390 |
| 7,559,487 | B2 * | 7/2009 | Gressett et al. | 239/549 |
| 2002/0134859 | A1 | 9/2002 | Gressett, Jr. et al. | |

FOREIGN PATENT DOCUMENTS

| | | | |
|---|---|---|---|
| DE | 6932202 | U1 | 8/1969 |
| DE | 69514404 | T2 | 1/2000 |
| DE | 29918424 | U1 | 2/2000 |
| DE | 69530243 | T2 | 4/2003 |
| DE | 202004001480 | U1 | 5/2004 |
| EP | 1344574 | A2 | 9/2003 |
| EP | 1579927 | A2 | 9/2005 |
| EP | 0936000 | B1 | 10/2007 |

OTHER PUBLICATIONS

German Patent Office, Search Report in Application No. 202006016674.4, Oct. 23, 2007.
European Patent Office, Search Report in Application No. 07119195, Jan. 16, 2008.

* cited by examiner

*Primary Examiner*—Steven J Ganey
(74) *Attorney, Agent, or Firm*—Wood, Herron & Evans, L.L.P.

(57) ABSTRACT

An applicator device for sheet application of liquid material including a main body, a nozzle assembly with at least one slotted application nozzle for dispensing the liquid material, and a clamping device attaching the nozzle assembly to the main body.

17 Claims, 11 Drawing Sheets

APPLICATOR DEVICE FOR APPLYING LIQUID MATERIAL

This application claims the priority benefit of German Utility Model No. 202006016674.2, the disclosure of which is hereby incorporated by reference herein.

TECHNICAL FIELD

The present invention relates to an applicator device for sheet application of liquid material.

BACKGROUND

Applicator devices, also known as application heads, are known for sheet application of liquid material, in particular hot melt adhesive. Such application heads have a main body, a nozzle assembly for dispensing the liquid material, and a valve system for controlling the dispensing of material. The nozzle assembly and the valve system are incorporated into the main body. The hot melt adhesive is fed to the main body under pressure and is directed from there to the valve system. Directing the adhesive from the main body to the valve system is controlled by the valve system, which also controls the dispensing of the hot melt adhesive from the nozzle assembly for application onto an application surface.

The nozzle assembly has at least one slit for this purpose, to ensure film-type or strip-type dispensing of the liquid material. The slit can have interruptions for this purpose, in order to output a plurality of strips side-by-side, possibly even at differing intervals from each other. In some cases the valve system has a plurality of slits that are controllable independently of each other.

The hot melt adhesive is fed to the main body at a high temperature, which may be, for example, up to 200° C. To avoid too great a temperature drop, heating devices are provided in the main body.

The valve system is attached to the main body by means of screw fittings. To achieve a definable orientation of the valve system with respect to the main body, and thus to the application surface during operation, drilled holes with corresponding pins are provided in the main body and the valve system.

A disadvantage here is that changing the nature and arrangement of the application of the hot melt adhesive, i.e., changing the application pattern—known as a format change—necessitates completely loosening all of the screws attaching the valve system to the main body. This makes a format change costly and also difficult, since both the loosened screws and the nozzle orifice can fall off when the last screw is loosened. Added to this is the fact that a detailed constructional adaptation of the valve system to the main body is necessary.

Another disadvantage with known applicator devices is that different material thicknesses of the hot melt adhesive can occur, depending on the position of the applied hot melt adhesive along the nozzle slit. Such a variation of the material thickness can be caused by an uneven temperature distribution.

The object of the present invention is thus to reduce the above-named problems as much as possible, or to eliminate them.

SUMMARY

Using a clamping device to attach the nozzle assembly to the main body avoids fastening elements on the nozzle assembly, in particular through holes that are matched to corresponding holes with threading in the main body. This makes it possible to increase the compatibility between nozzle assemblies and basic bodies. In addition, a simplification of the design of the nozzle assembly is achievable, since when arranging the cavities and, in particular, channels to carry the hot melt adhesive within the nozzle assembly, it is no longer necessary to pay attention to the named attachment holes. The former encroachment of attachment holes on the inner geometries of the nozzle assembly is thus no longer present.

All that is needed to install or uninstall a nozzle assembly and, in particular, to exchange a nozzle assembly, is to release the clamping in order to loosen the attachment far enough so that, for example, the nozzle assembly can be removed by pulling it out transversely to a clamping direction. The effort of removing a large number of screws no longer needs to be made. This also counteracts the loss of screws. That also prevents screws from falling into other parts of the system when the nozzle assembly is being exchanged.

In an advantageous manner, the clamping device has at least one clamping section affixed to the main body and/or at least one clamping means or element that is attachable to the main body. For attaching, in an advantageous design the nozzle assembly is held between a fixed clamping section and at least one clamping means or element that is attachable to the main body. The fixed clamping section here is firmly attached to the main body, in particular it is made in a single piece with the latter. This clamping section together with the main body thus forms a stable design and offers a flank against which the nozzle assembly is placed for attaching. From the other side of the nozzle assembly one or more clamping elements are provided, which are attached to the main body for example by means of screws and thereby hold the nozzle assembly together with the clamping section. In such an attached state the nozzle assembly has one side against the clamping section and another side against the clamping elements. With a third surface the nozzle assembly is in contact with another surface of the main body, namely, in the area of dispensing orifices for hot melt adhesive. Corresponding with these orifices in the main body, there are orifices in the nozzle assembly to receive the hot melt adhesive, which correspond to the forenamed dispensing orifices in the main body. In principle, however, the dispensing orifices can also be situated in the area of the clamping section.

In an advantageous embodiment, the clamping device has a plurality of clamping elements spaced apart from each other. This sort of spaced arrangement is often adequate to achieve uniform attachment. The use of a plurality of spaced clamping elements, in particular identical ones, has the advantage that the same clamping elements can be used for applicator devices of different sizes, with a number of clamping elements that corresponds to the size of the applicator device being used for the attachment.

The preferred embodiment is an applicator device according to the invention, characterized in that the main body has a contact surface for placing the nozzle assembly and the clamping section has a clamping section surface and/or the clamping element has a clamping element surface, and the contact surface to the clamping section surface, and/or in the attached state to the clamping element surface, spans an angle of less than 90°. This causes an undercut area to be formed between the contact surface for placing the nozzle assembly and the clamping section surface, into which the nozzle assembly is inserted for attaching. When clamping elements are used, in the attached state such an undercut area between the clamping means and the contact surface also results. When the nozzle assembly is attached by means of the clamping device, in one case the attachment comes about between the clamping section and at least one clamping element. The clamping section and the clamping element operate here like two gripping jaws which grip the nozzle assembly between them. The oblique position of the clamping section surface and the clamping element surface results in an additional force which acts on the nozzle assembly in the direction of the contact surface of the main body. In an advantageous design, there is at least one orifice present in the contact surface of the main body to dispense liquid material to the nozzle assembly. Pressing the nozzle assembly in the direction of the contact surface thus also promotes in addition a connection between at least one discharge opening in the main body and a corresponding input opening in the nozzle assembly.

Preferably, the clamping device has at least one tensioning means or element to clamp the nozzle assembly in position. Such a tensioning means or element is provided in order to exert force on the nozzle assembly, so that the latter is held firmly in the clamping device. The tensioning element thus increases a clamping force of the clamping device on the nozzle assembly, or in a preferred design brings about largely or exclusively only the clamping or tensioning force on the nozzle assembly needed to attach the nozzle assembly. Advantageously, the tensioning element has at least one clamping screw, which is advantageously formed in at least one clamping element. Such a tensioning element can also be formed in a different way in the clamping element, for example by a lever arrangement.

In a preferred variant, the clamping element each have a threaded hole in which a threaded pin is situated. In the assembled state the threaded holes are directed toward the nozzle assembly, and in particular they run perpendicular to the surface of the clamping element; when the threaded pin is screwed in the appropriate direction the threaded pin presses against the nozzle assembly, thereby resulting in a firm bracing between nozzle assembly and clamping device.

To release the clamping device in order to be able to perform an exchange of the nozzle assembly, each threaded pin is released from the nozzle assembly by turning it in the appropriate direction. The threaded pin does not have to be completely unscrewed from the threaded hole for this purpose. Instead, it is sufficient if the respective threaded pin no longer extends beyond the surface of the respective clamping element. The nozzle assembly can then be pulled along the surfaces of the clamping element out of the clamping device, and at the same time along the contact surface and a clamping section surface, and thereby be removed from the applicator device. After concrete dimensioning of the clamping device and the nozzle assembly it can sometimes be necessary to loosen the clamping element further, but without removing them completely from the main body. The clamping device is thus released in particular by the tensioning element, and the nozzle assembly can be pulled out of the clamping device transversely to a tensioning direction and another nozzle assembly can be inserted into the clamping device. No part of the attaching device that is designed according to the invention as a clamping device, in particular no screws, need to be removed completely. In one embodiment the clamping element can be removed completely, however, in order to be able to remove a nozzle in other directions when necessary, for example downward, or to perform servicing.

To ensure that the nozzle assembly is attached at its intended place in the clamping device, advantageously at least one positioning means or element is provided to position the nozzle assembly. Such a positioning means or element can be realized for example by two corresponding geometries, where the nozzle assembly has one geometric shape and the main body and/or the clamping device has a shape that corresponds thereto. In one embodiment, at least one positioning element has a stop against which the nozzle assembly is pushed. Such a stop can be attached to the main body and/or the nozzle assembly for example as a screw with a screw head and possibly a washer.

In an advantageous design, the positioning element has at least one recess in the nozzle assembly or the clamping device and at least one corresponding element to engage the recess. The recess and the element engaging it are designed so that a shift of the nozzle assembly transversely to a tensioning direction, i.e. a shift along the contact surface, clamping section surface and/or clamping element surface is prevented.

Advantageously, the corresponding element is designed as a movable element, in particular, as a threaded pin in the clamping element. Because the corresponding element is movable, it can be moved away to pull a nozzle assembly out or insert it into the clamping device, so that this removal or insertion is not hindered by the corresponding element. The nozzle assembly is then pushed into its position in the clamping device, and the corresponding movable element is moved into the recess. In an advantageous design a threaded pin is screwed into the recess. Advantageously, the threaded pin is provided with a point and the recess is designed with sloping flanks in the nature of a chamfer. When the threaded pin is screwed point-first into the indentation-like recess, that can not only fix the position of the nozzle assembly, but also the interaction between the point of the threaded pin and at least one sloping flank of the recess can bring about an additional change, namely correction of the position of the nozzle assembly. Such an effect can be achieved for example by a conical design of the recess.

It is advantageous when a positioning element corresponds at least in part with a tensioning element. In one embodiment, a threaded pin with a point is used initially for positioning here after a nozzle assembly is inserted into the clamping device. To this end, the threaded pin is rotated and at the same time moved into a corresponding recess, in order to thereby get the nozzle assembly into its final position and secure it there against shifting. By screwing this threaded pin even further in the direction of the nozzle assembly, this threaded pin also achieves a tension that acts on the nozzle assembly. This threaded pin thus functions on the one hand as a tool for positioning and on the other hand as a tensioning means element. Other tensioning element can be provided, which however do not have to be intended as positioning element, since a nozzle assembly inserted into the clamping device can only move in one direction, and thus in principle only one positioning device is necessary.

In another preferred embodiment the clamping device has two opposing fixed clamping sections, in order to thereby fasten a nozzle assembly between these two clamping sections. Both clamping sections are preferably formed here in a single piece with the main body. Preferably, the clamping device here has a U-shape in a cross section transverse to the direction of insertion of the nozzle assembly, and thus transverse to the contact surface and/or one of the clamping section surfaces, or encloses a dovetail-shaped space. At the same time, preferably tensioning elements for secured attachment of the nozzle assembly are provided within this form in one leg of such a clamping device, and thus in one clamping section. In particular, such clamping elements are executed as threaded holes with threaded pins transverse to one leg.

By providing an elastic clamping element, which is preferably in the form of a sheet-metal spring, a tensioning force that acts on the nozzle assembly to attach it is predeterminable through the geometry of the clamping device matched to the nozzle assembly and the concrete design, including the material used for the elastic clamping element. Thus to attach a nozzle assembly the latter is inserted into the clamping device and the elastic clamping element is attached to the main body—in particular, it is screwed on firmly. This causes the elastic clamping element to come under tension, which acts on the nozzle assembly to attach it.

In a preferred embodiment, a holding element is attached to the clamping section. Such a holding element extends beyond the clamping section surface in the direction of an attached nozzle assembly. This enables an undercut area to be realized for the clamping section including the holding element, without the clamping section with its clamping section surface having to be incorporated into the main body as an undercut area. Such an undercut area produced by the holding element promotes holding of the nozzle assembly in the manner already described above.

By preference, the nozzle assembly has at least one indentation, in particular a groove to engage an edge of the clamping section, the clamping element and/or the holding element. This enables the attachment of the nozzle assembly to be improved, since the engagement of the clamping device in a groove of the nozzle assembly improves the hold of the nozzle assembly. At the same time, when the clamping device is released the nozzle assembly can be slid out or slid back in, as with other embodiments.

It is further proposed according to the invention to provide an applicator device with a nozzle assembly that has a nozzle for dispensing the liquid material and a nozzle receptacle to hold the nozzle. It is possible here to create a nozzle that does not require any through holes for attachment. Hence, a nozzle can be exchanged in a simple manner, and any channels for hot melt adhesive are independent of the attachment. It is advantageous if the nozzle receptacle is approximately U-shaped in design in a front view, and if the nozzle assumes a U-shape in such an interior space. Advantageously, clamping elements are provided here, in particular clamping screws to clamp the nozzle in place. Thus, for example, by arranging a plurality of clamping screws in a leg of a U-shaped nozzle receptacle, they can be tightened against the nozzle to attach it solidly. This enables the nozzle to be held firmly without having to have attaching holes itself.

According to another preferred embodiment, a spacing element is provided between the nozzle and nozzle receptacle, in particular a spacer plate, whereby a space between the nozzle and nozzle receptacle at a contact surface is ensured, in order to thereby form a dispensing slit and thus a slotted application nozzle. At least one fixing element is provided to fix the spacing element in the nozzle assembly. This creates a firm hold for the spacing element without need of tightly screwing down the latter directly, if the fixing elements are designed, for example, as locating pins.

Through the use of heating devices, the main body as well as the nozzle assembly, control parts and other adhesive-carrying elements are heated, thereby counteracting the cooling of hot melt adhesive in the main body. It has been recognized according to the invention that hot melt adhesive sometimes exhibits great deviations in application thickness in the edge zones of the slit of the slotted application nozzle, i.e., toward the end faces of the applicator device, in comparison to application areas in the middle zone of the slotted application nozzle. At the same time, it has been recognized that the hot melt adhesive cools down too much in these areas and thereby causes the variations. Instead of fitting additional heating elements or heating zones into this area, it is proposed that the heating capacity of some heating elements be increased, in order to thereby achieve insofar as possible a uniform and stable temperature profile in the main body and/or system. Such a stabilizing thermal profile at the same time stabilizes the temperature distribution of the hot melt adhesive in the slotted application nozzle, and counteracts variations in the application thickness.

By preference, heating elements here in the area of the end faces of the applicator device are equipped with higher heating capacity. The heating capacity of a heating element in the end zone is about 20 to 200% greater than that of other heating elements in the same applicator device, preferably 50 to 120%, even more preferred 60 to 100% greater. The heating elements here in an advantageous embodiment are already adjusted to a higher heating capacity by their dimensioning. This enables the actuation of the heating elements to remain the same in terms of the cost and effort of control, and all heating elements can be actuated alike simultaneously. An increase in the heating capacity then results solely from the dimensioning of the particular heating element. An increase in physical size is normally not required here, but may be preferred to avoid confusion.

By preference, the applicator device is equipped with at least one insulation board to insulate the heating device and/or the main body thermally. This not only addresses the loss of thermal energy, but more importantly it ensures an improvement in the uniformity of a thermal profile. Preferably, at least one insulating board is situated at each end of the applicator device. The emission of thermal energy to the environment from the applicator device, and thus a temperature drop in the applicator device, is lessened by reducing the emission of thermal energy at the ends. The total emission of thermal energy in the area of the ends, i.e. in the marginal zone of the applicator device, is thus brought more into line with central zones that are distant from the ends. This promotes stabilization and the achievement of a maximally uniform temperature profile. It is possible in this way to improve temperature distribution without specifically selecting individual zones of the applicator device independently of other zones. Accordingly, it also remains sufficient to use a single temperature sensor in small applicator devices, or for each heating zone where there are multiple heating elements in large applicator devices.

BRIEF DESCRIPTION OF THE DRAWINGS

The present invention will be explained below in greater detail with reference to the figures, on the basis of some exemplary embodiments. The figures show the following.

DETAILED DESCRIPTION

Figure 1:
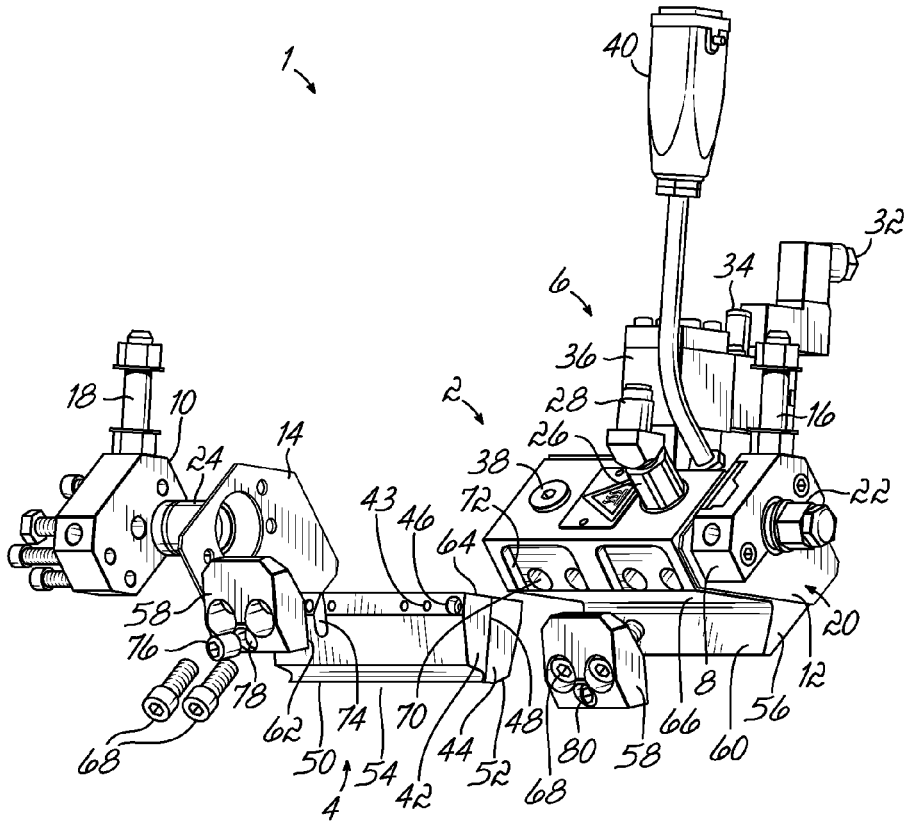
FIG. 1 is a perspective view of an applicator device according to a first embodiment of the invention.

Applicator device 1 according to FIG. 1 has a main body 2, a nozzle assembly 4 and a valve system 6. Main body 2 is provided with a first and a second holder 8, 10. Holders 8, 10 are fastened to main body 2 with one each first and second insulating boards 12, 14 interposed. The insulating boards normally consist of layered, resin-impregnated paper, as well as mica material and also sandwich compounds. Temperature differences of 40° K can be reached between main body 2 and adjacent holders 8 and 10. The applicator device is thus mountable in a corresponding production unit by means of the attaching pins 16 and 18, which here are in the form of threaded pins.

From an operator side, which is depicted on the right in FIG. 1, a filter 20 for filtering the hot melt adhesive which is to be applied is inserted into main body 2. Of the filter 20, the filter head 22 with a hexagonal nut is visible in FIG. 1. Filter 20 extends through holder 8 and insulating board 12 into the main body. In the assembled state, filter 20 is one of the things held in filter holder 24. A dummy plug 24, which is used when no filter is used, is inserted in that case from the end facing away from the user into main body 2 through second insulating board 14 and is attached to second holder 10.

An input 26 is provided to supply the applicator device with hot melt adhesive. To this end, a supply line is connected to the supply connection 28 of input 26 to supply hot melt adhesive. The hot melt adhesive passes through input 26 into filter 20 and there through a filter body, and is then delivered to nozzle assembly 4 through dispensing orifices.

Applicator device 1 of FIG. 1 has a control unit, whereas other applicator devices operate without controlling the outflow of adhesive. The outflow of hot melt adhesive through the dispensing orifices is controlled according to FIG. 1 by way of a control unit 6, which has a valve system. Control unit 6 has an electrical connection 32 for this purpose to supply the control signals, and a pneumatic connection 34 to provide working pressure to move valves of the valve system. To execute the control signals there is a pneumatic cylinder 36, whose outer rectangular body is recognizable in FIG. 1.

Main body 2 has yet another opening for supplying hot melt adhesives, but it is closed with a dummy plug 38 and has no other significance in the depicted configuration of the applicator device.

A main electrical connection 40 is provided for the general supply of electricity to applicator device 1. Via this main electrical connection 40 it is possible to transmit electrical signals, switch signals and measurement signals, as well as electrical energy. For example, the switch signals for control unit 6 can also be transmitted via the main electrical connection 40; these are then forwarded from the main body at the electrical connection 32 of control unit 6. This necessitates the provision of electrical connections, which however are not illustrated in FIG. 1.

Electrical energy for heating the applicator device 1 in main body 2 can also be supplied through the main electrical connection 40.

Nozzle assembly 4 is made up essentially of a nozzle 44 and a nozzle adapter 42 by means of screw fitting 46. Openings 43 are provided for locating pins. Situated between nozzle 44 and a nozzle adapter 42 is a flat intermediate element, known as a spacer plate 48. Nozzle assembly 4 also has a dispensing slit 50. According to the depiction in FIG. 1, dispensing slit 50 is situated beneath nozzle assembly 4. An adhesive outlet or dispensing slit can also be incorporated directly into a nozzle assembly, in particular into the nozzle and/or the nozzle receptacle. Spacer plate 48 extends to this dispensing slit 50, for example in order to subdivide dispensing slit 50 into a plurality of sub-slits. During use as intended, an application surface is moved along under the nozzle assembly to apply the hot melt adhesive, in the direction coming from nozzle 44 and moving in the direction toward nozzle adapter 42. The application surface thus first reaches a slightly rounded area 52 on nozzle 44. In the area of dispensing slit 50 nozzle adapter 42 has a tear-off edge 54.

To attach the nozzle assembly 4, applicator device 1 has a fixed clamping section 56, which is formed in a single piece with the main body 2, as well as two clamping means or elements 58 that are attachable to the main body. The clamping section 56 and the clamping means 58 are designed to clamp nozzle assembly 4 between them. With such clamping, nozzle assembly 4 bears against clamping section surface 60 with its nozzle 44, and nozzle adapter 42 bears against two clamping means surfaces 62. In addition, nozzle assembly 4 then bears upward with a connecting surface 64 against a contact surface 66 of main body 2. Clamping section surface 60 is at an angle of about 75° to contact surface 66. In the assembled state the clamping means surfaces 62 of clamping means 58 are likewise at an angle of about 75° to contact surface 66.

To attach the nozzle assembly, the clamping means 58 in turn are attached to the main body 2, in which the attaching screws 68 are screwed into the corresponding threaded holes 70. For a solid seating of the clamping means 58 on the main body 2, the latter has corresponding clamping means seats 72, which are incorporated into the main body 2. To position nozzle assembly 4 in a direction of motion transverse to dispensing slit 50, and in part also to fix its position, a recess 74 shaped for example like a notch is formed in nozzle adapter 42. For positioning, a threaded pin 76 with a point that corresponds approximately to the recess 74 is provided, which is screwed into the threaded hole 78 in clamping means 58 for this purpose and in so doing is moved into the recess 74. This simultaneously causes a tensioning, in that the threaded pin 76 exerts a force on nozzle assembly 4. There is another tension pin 80 provided as a tensioning means or element in one of the clamping means 58, which is likewise guided in a threaded hole, in order to be screwed in the direction of nozzle assembly 4 in the area of nozzle adapter 42. However, tension pin 80 has an essentially flat surface directed toward nozzle assembly 4, and thus in contrast to threaded pin 76 does not have a dual function. The threaded pin is thus intended for positioning nozzle assembly 4 as part of a positioning means. Threaded pin 76 and tension pin 80 are both designed as parts of the tensioning means for clamping the nozzle assembly in position.

Figure 2:
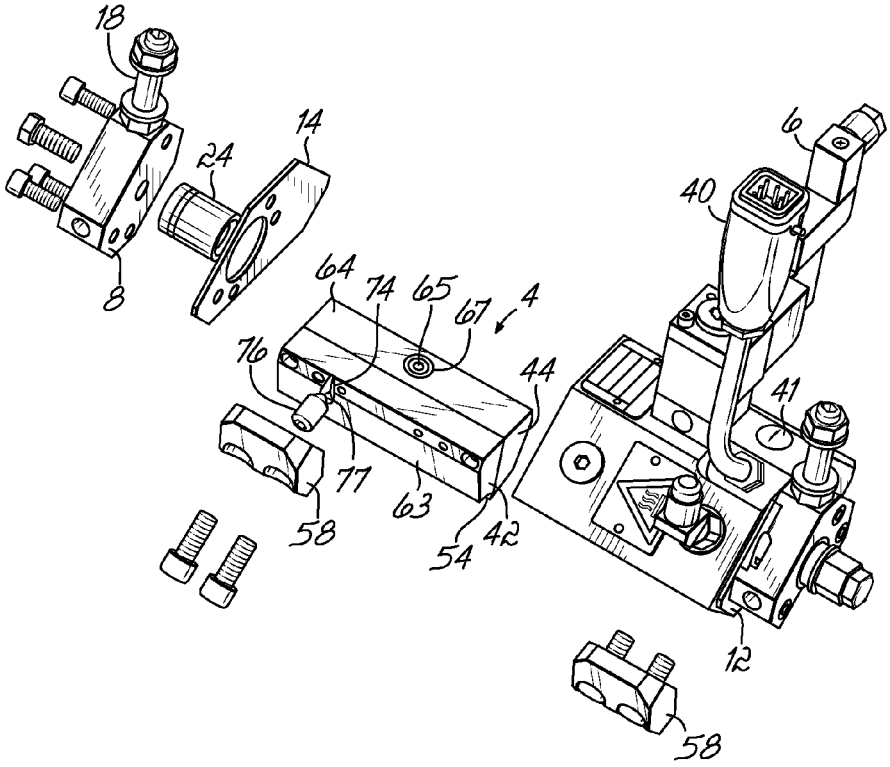
FIG. 2 is a different perspective view of the applicator device according to FIG. 1.

FIG. 2 shows a feed opening 65 in contact surface 64 for inputting hot melt adhesive. To seal it, a seal 67 is provided, which has an X-shaped cross section and is known as a quad-ring. In principle, it is also possible to use an O-ring. In contrast to FIG. 1, the threaded pin 76 in FIG. 2 is situated close to the recess 74. When attaching the nozzle assembly 4, threaded pin 76 must first be moved with its positioning point into the recess 74 for positioning, by screwing it. As it is screwed further and tightened, an additional attaching tensioning occurs between the main body 2 and the clamping means 58 on the one hand and the nozzle assembly 4 on the other hand.

In addition, an electric dummy plug can also be seen from FIG. 2, which covers an opening in the main body from which an electrical connection can be passed when needed.

Figure 3:
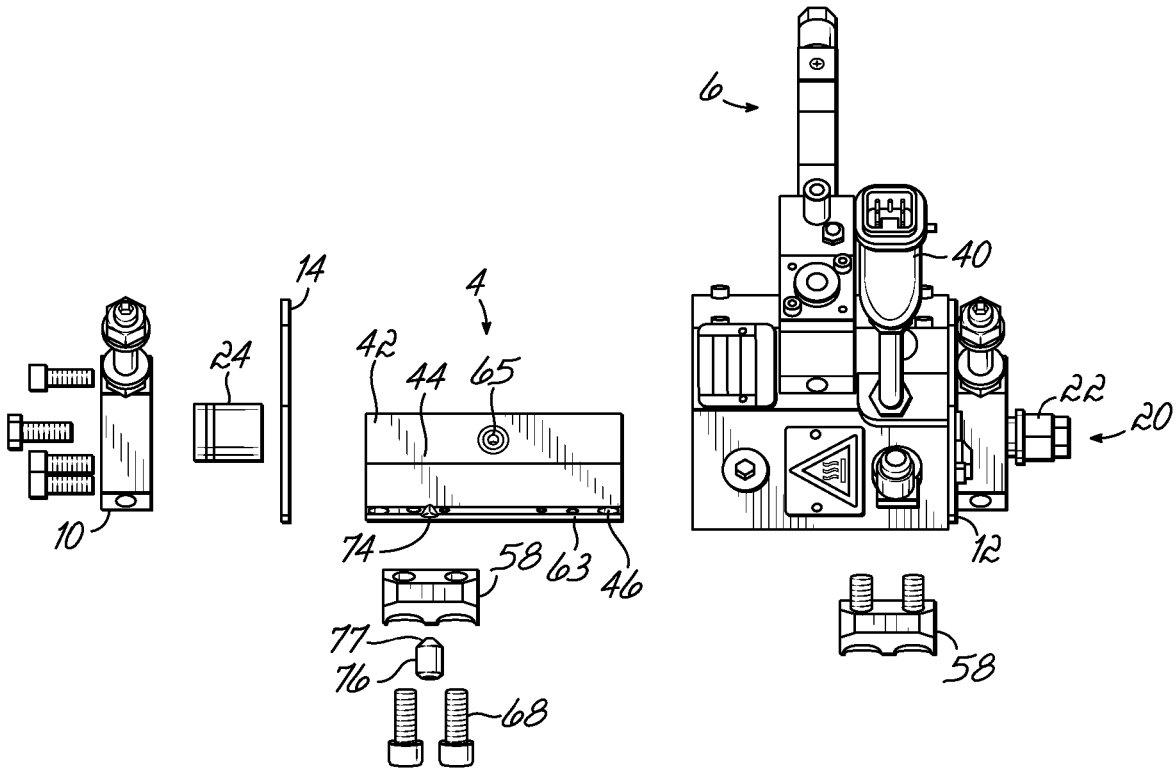
FIG. 3 is a different view of the applicator device according to FIGS. 1 and 2.
Figure 4:
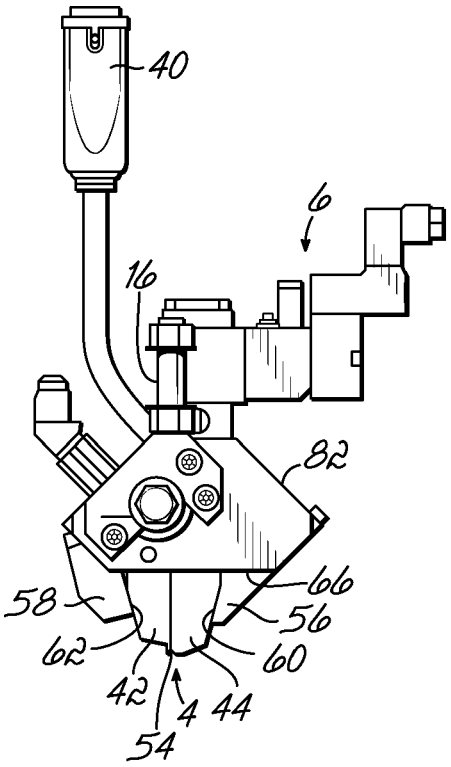
FIGS. 4 to 7 show the assembled applicator device according to FIGS. 1 through 3 in a first end view, a side view, a second end view and a top view.

FIG. 3 clarifies the orientation between nozzle assembly 4, with recess 74 situated in it for positioning with the clamping means 58 including attaching screws 68, and in particular the threaded pin 76 with its positioning point 77.

Insulating boards 12 and 14 are designed as flat elements.

Applicator device 1 is shown at a smaller scale in FIGS. 4 through 7 than in FIGS. 1 through 3. From the depicted assembly it is also possible to see from the end view according to FIGS. 4 and 6 how nozzle assembly 4 is clasped by fixed clamping section 60, attachable clamping means 58 and also the contact surface 66 of main body 2. Viewed from contact surface 66, clamping section surface 60 and clamping means surfaces 62 run toward each other as the distance from contact surface 66 increases. This achieves a firm clasping, which also prevents nozzle assembly 44 from sliding out transversely to the contact surface 66.

As threaded pin 76 is tightened, nozzle assembly 4, which initially hangs in clamping device 1, will slide up on the clamping section surface 60, in order to then be in contact with the contact surface 66. Clamping section surface 60 is normally greased for this purpose.

Figure 5:
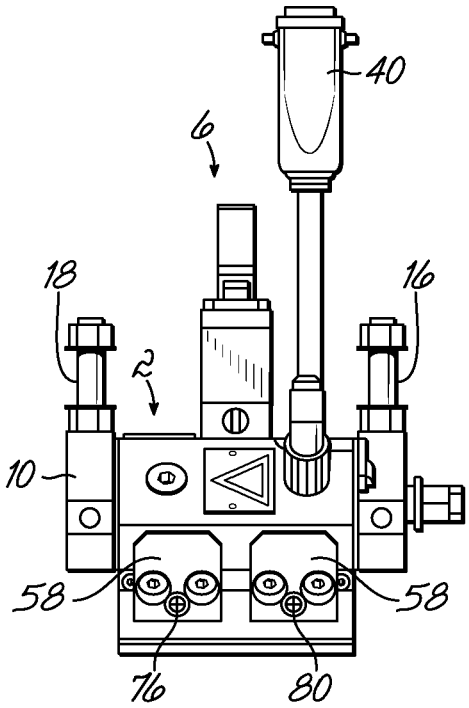
Figure 6:
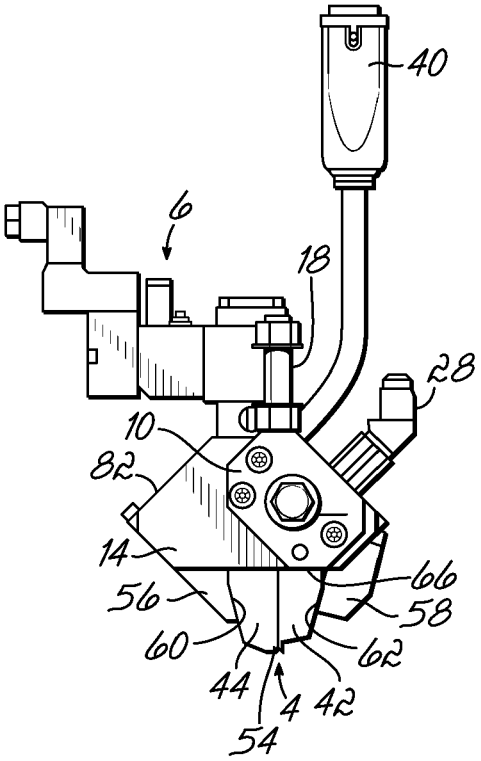

It can be seen from FIG. 5 that in the assembled state the clamping means 58 are attached to main body 2 at a small distance from each other. Threaded pins 76 and 80 are situated in the same position in their respective clamping means. Compared to threaded pin 80, threaded pin 76 has the additional function of positioning the nozzle assembly.

Figure 7:
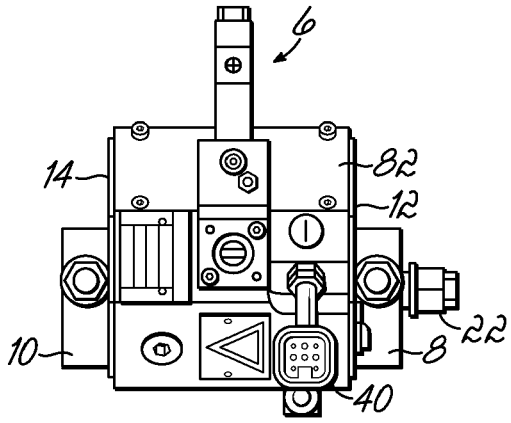

The top view according to FIG. 7, in contrast to the other views, also clearly shows an electrical cover 82. Electrical connections are stowed and heating modules are also situated beneath this electrical cover 82.

Figure 8:
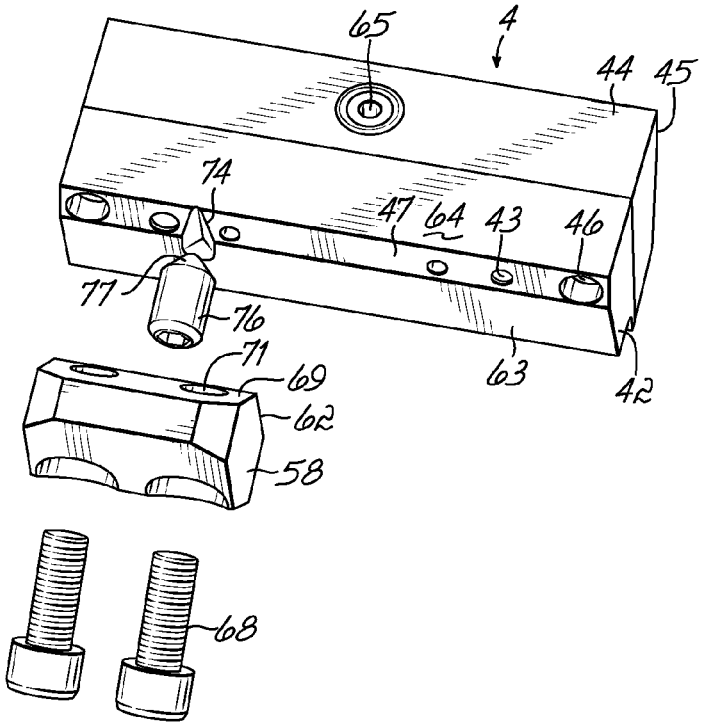
FIG. 8 is a perspective view of a nozzle assembly with a clamping means or element of an applicator device according to FIGS. 1 through 7.
Figure 9:
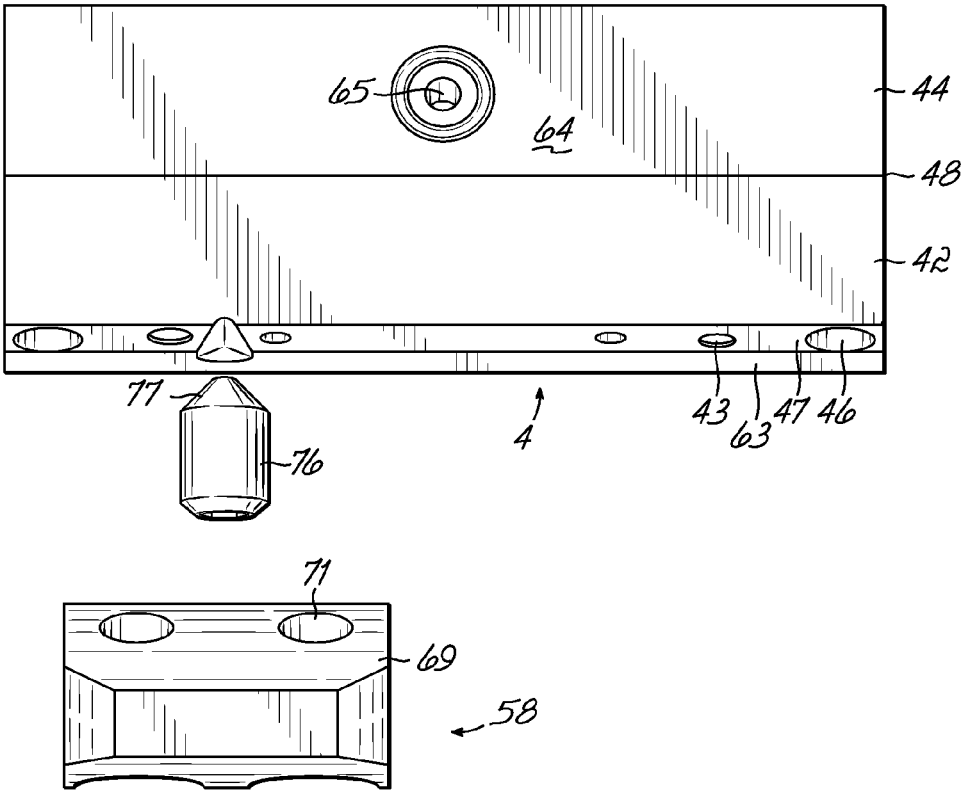
FIG. 9 is a different view of a part of the nozzle assembly with a clamping element according to FIG. 8.

Nozzle assembly 4 including a clamping means 58 with a threaded pin 76 is visible in greater detail from FIGS. 8 and 9. Clamping means 58 has a prismatic shape. Drilled holes 71 for passing through the attaching screws 68 extend through an attaching surface 69. To attach clamping means 58, they are attached to the main body 2 by means of screws 68 by screwing the attaching screws 68 into threaded holes 70 (FIG. 1) in the main body 2, which cause the attaching surface 69 to bear against the main body in a clamping means seat 72. The position or orientation of the clamping means 58 relative to the main body 2 is determined by the clamping seat 72. Threaded pin 76 is now screwed into recess 74 in nozzle assembly 4 to position the nozzle assembly. In the assembled state, threaded pin 76 protrudes in its threaded hole through clamping means surface 62. Clamping means surface 62 is then in contact with a first block surface 63 of nozzle adapter 42 on nozzle assembly 4. A screw fitting surface 47 in the area of the screw fittings 46 is offset at a slight angle from the first blocking surface 63, so that it does not rest against clamping means surface 62. Threaded pin 76 is positioned here obliquely to the attaching screws 68.

Nozzle 44 has a second screw fitting surface 45. Screw fitting surface 47 and second screw fitting surface 45 are situated approximately plane-parallel to each other, in order to thereby shape the connection of nozzle 44 to nozzle receptacle 42 simply.

Figure 10:
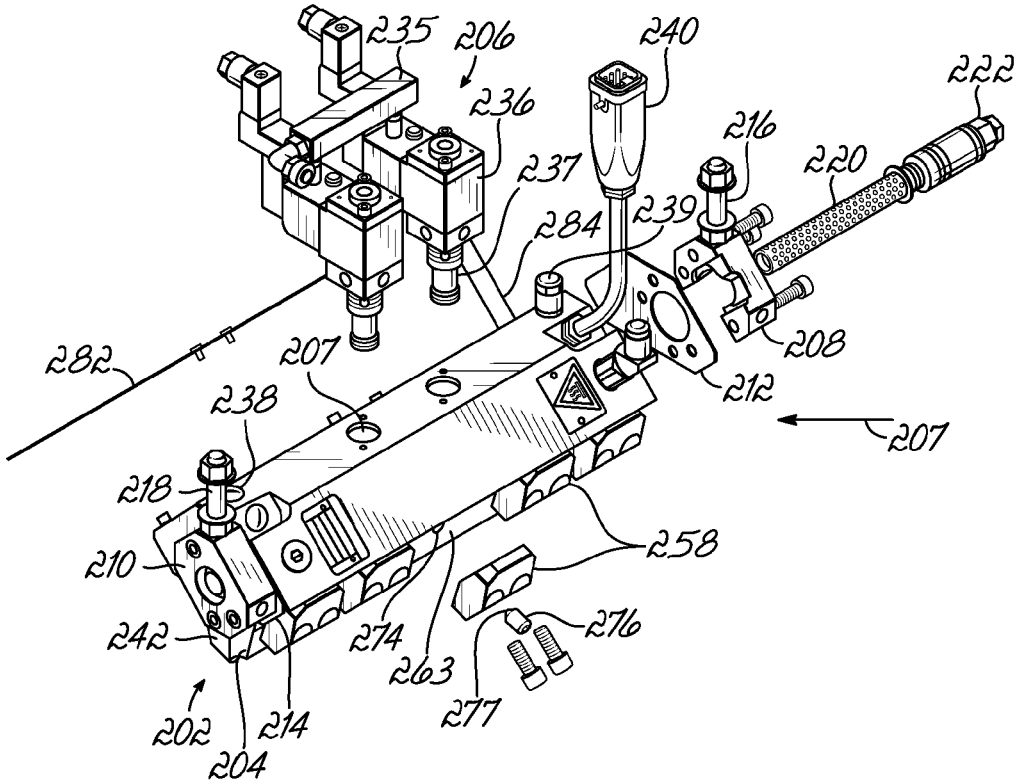
FIG. 10 is a perspective view of an applicator version according to a second embodiment, in a partial assembly drawing.

The applicator device according to the second embodiment according to FIG. 10 has two control units 206, which are connected with each other through a common pneumatic connection 235. Control units 206 have a jet carrier 237 under their pneumatic cylinder 236. To assemble applicator device 201, the control units 206 with their jet carriers 237 are inserted into two openings 207 in the main body 202. In the assembled state, the jet carriers 237 then run at a slight distance from each other transversely to the inserted filter 220. Applicator device 201 has in addition an electrical screw connection 239 and a dummy plug 238 for an unused electrical supply line.

Nozzle assembly 204 is attached to main body 202 here by means of five clamping means or elements 258. The middle clamping means 258, shown unmounted, is equipped with a threaded pin 276 with a point 277. For positioning, threaded pin 276 in clamping means 258 is pushed into the recess 274 for positioning, by means of screws. Since threaded pin 276 is centered in the middle clamping means 258, and recess 274 is also centered in nozzle assembly 204, the positioning can also be referred to here as centering. The clamping means 258 are identical in design to the clamping means 58 according to the first embodiment according to FIGS. 1 through 9. Thus for large and small applicator devices 1 and 201 respectively, and nozzle assemblies 4 and 204 of correspondingly differing sizes, it is thus possible to effect an attachment with the help of the same clamping means 58 (FIGS. 1-9) or 258 (FIGS. 10-15). Only the number of clamping means 58 or 258 used varies. In each case, one clamping means 58 or 258 performs the positioning of nozzle assembly 4 or 204 by means of a threaded pin 76 or 276.

A plurality of heating cartridges are used to heat applicator device 201. An outer heating cartridge 284 is shown in the withdrawn state in the area of main electrical connection 240.

Figure 11:
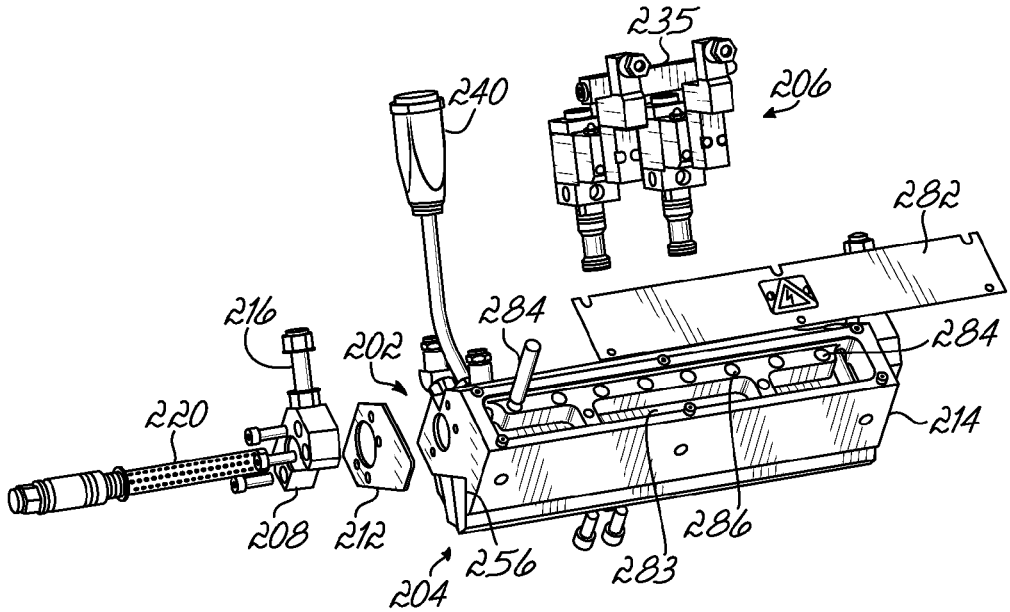
FIG. 11 is a different perspective view of the applicator device according to FIG. 10.
Figure 12:
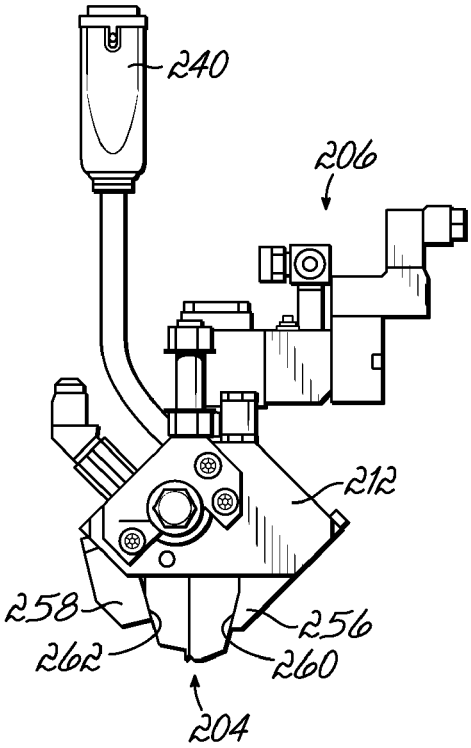
FIGS. 12 to 15 show an applicator device according to FIGS. 10 and 11 in the assembled state in a first end view, a side view, a second end view and a top view.
Figure 13:
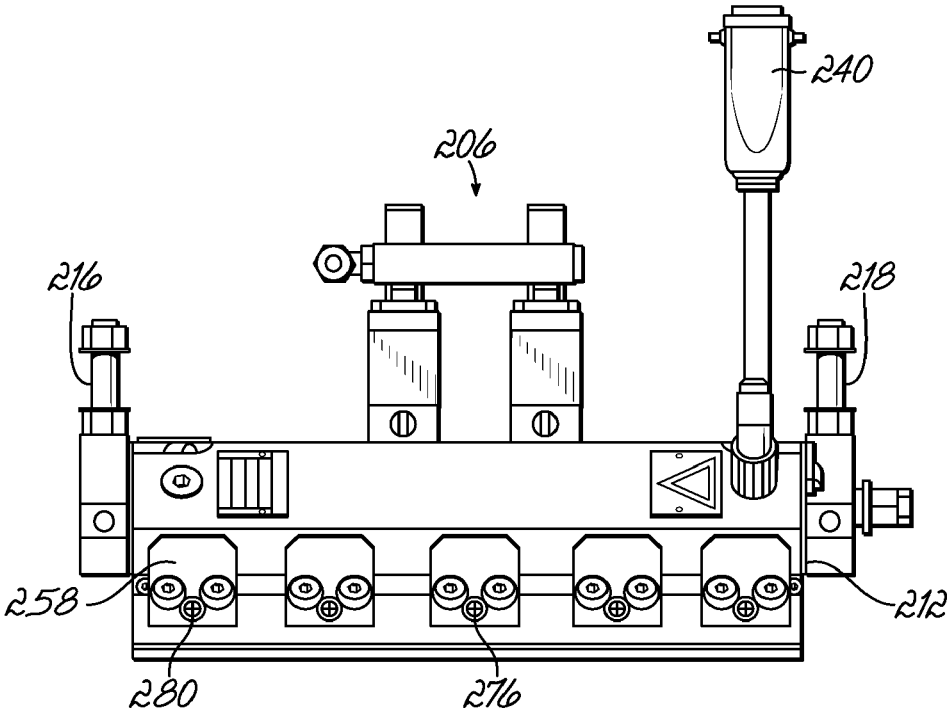
Figure 14:
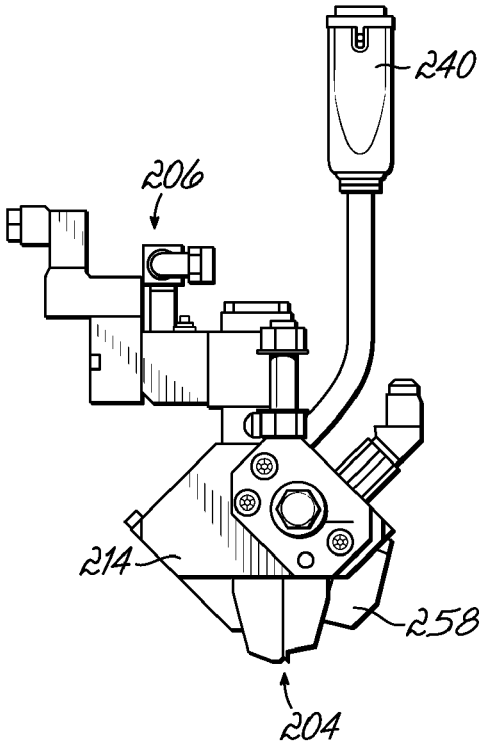
Figure 15:
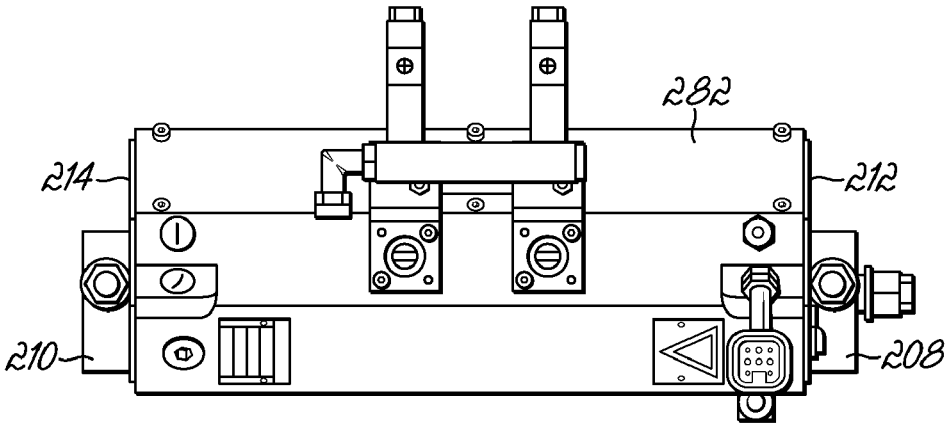

The positions of all heating modules, in this case heating cartridges, can be seen from FIG. 11. According to that illustration there are two outer heating cartridges 284 and six inner heating cartridges 286 present. Outer heating cartridges 284 are situated in the vicinity of first and second insulating boards 212 and 214. They both have a rated heating power of 200 watts. Situated between the two outer heating cartridges 284 are the six inner heating cartridges 285, which each have a rated heating capacity of 125 watts. Adjacent to the heating cartridges 284, 286 are connecting compartments 283 for guiding and connecting electric power lines. To this end, the electronic connections lead from the main electrical connection 240 into the main body 202 and from there back to the connecting compartments 283. The electrical connection of the heating cartridges 284 and 286 also takes place here. In the assembled state, both the heating cartridges 284, 286 and the connecting compartments 283—and with them the electrical connections that have been made—are shielded toward the outside by electrical cover 282.

FIGS. 12 through 15 show applicator device 201 according to the second embodiment, in four views that correspond to the views according to FIGS. 4 through 7 of the first embodiment. The second embodiment has five approximately evenly spaced fastening elements 258. Two control units 206 are present to control the dispensing of the hot melt adhesive. Reference labels of like or similar elements of the first, second and third embodiments differ only in the third digit, the hundreds digit. Reference labels of the second embodiment are in the two-hundred range, those of the third are in the three-hundred range.

Figure 16:
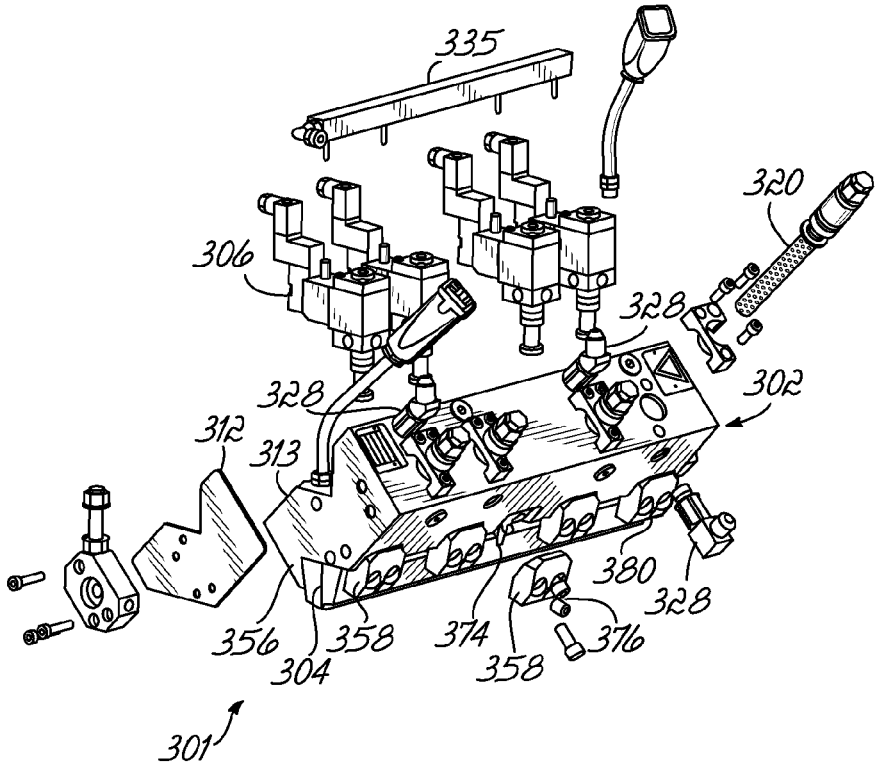
FIG. 16 is a perspective view of an applicator device according to a third embodiment, in a partial assembly drawing.

Applicator device 301 according to the third embodiment and according to FIG. 16 has four hydraulically independent zones for hot melt adhesive. Accordingly, there are four control units 306 present, which may be connected to the pneumatic power line through a distribution manifold 335. In other embodiments, separate pressure supply lines can also be provided. Four filters 320 and four supply connections 328 are also provided. For reasons of space for the adhesive supply line (supply hose), the supply connections 328 are offset. Nozzle assembly 304 is attached by means of five clamping means or elements 358, as in the case of the second embodiment, with the middle one of these clamping means 358 having a threaded pin 376 for positioning the nozzle assembly 304. A recess is provided for this in nozzle assembly 304, into which threaded pin 376 is supposed to mesh. The other clamping means 358 each have a threaded pin 380 without a point. On the side opposite the clamping means 358 nozzle assembly 304 is held by the fixed clamping section 356, which is formed in a single piece with the main body 302.

Insulating board 312 is shaped, in particular in its outline, to fit end face 313.

Figure 17:
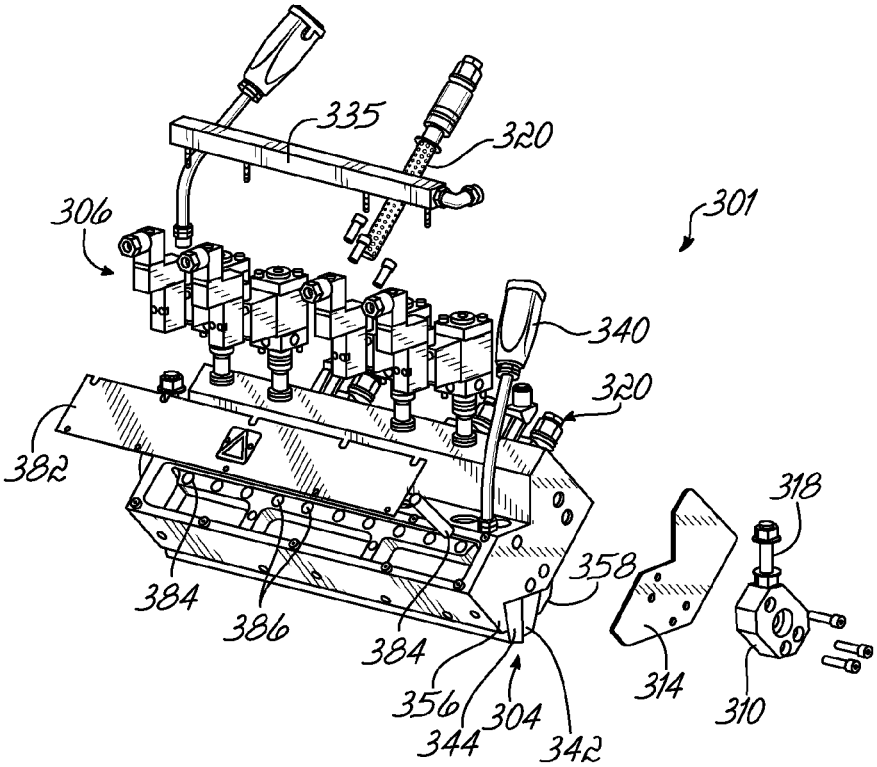
FIG. 17 is a different perspective view of an applicator device according to FIG. 16.
Figure 18:
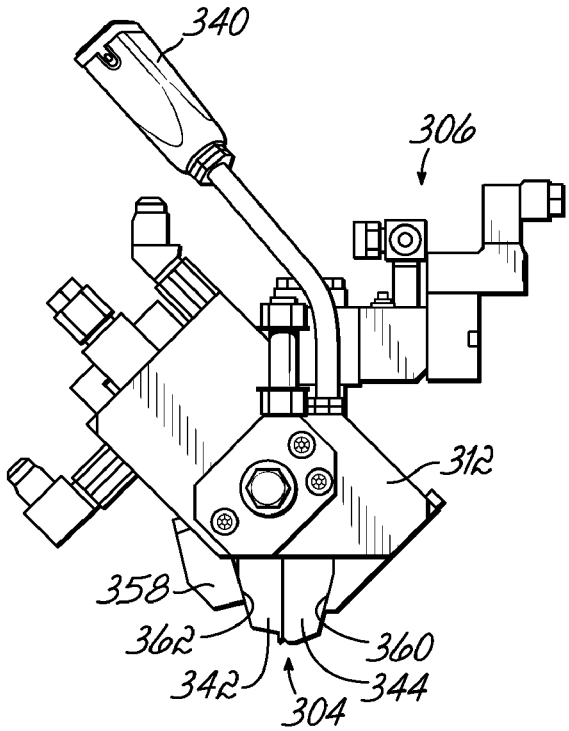
FIGS. 18 to 21 show an applicator device according to FIGS. 16 and 17 in the assembled state in a first end view, a side view, a second end view and a top view.

Applicator device 301 according to FIG. 17 has two outer heating cartridges 384 and eight inner heating cartridges 386. The outer heating cartridges 384 have a higher heating capacity than the inner heating cartridges 386.

Figure 19:
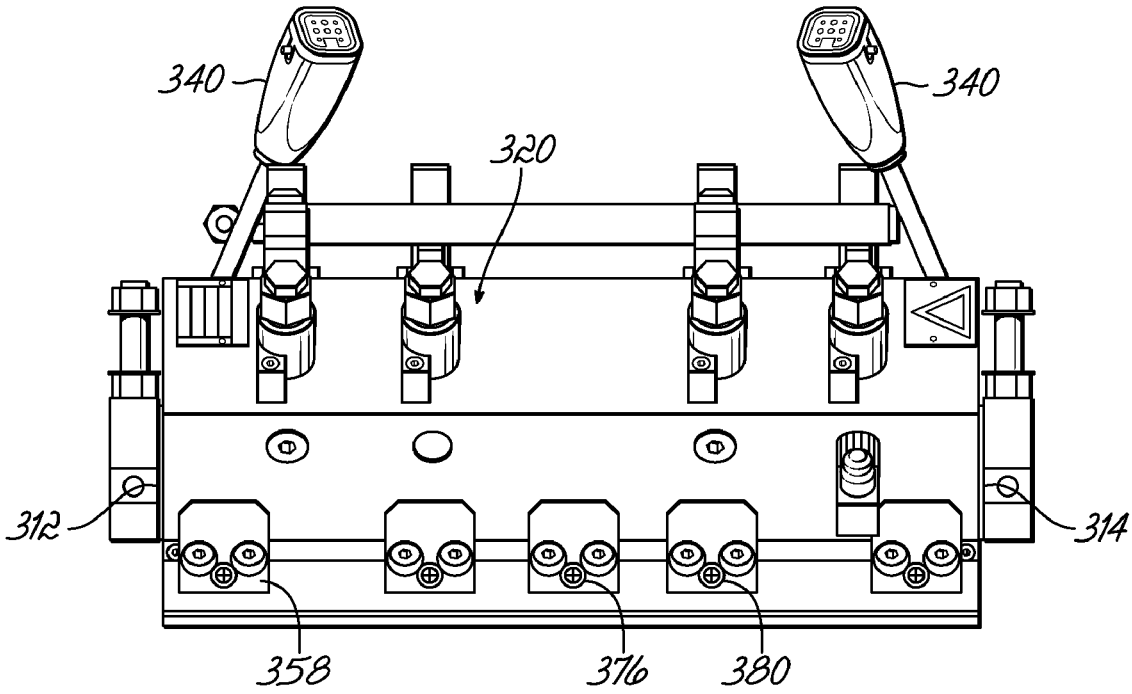
Figure 20:
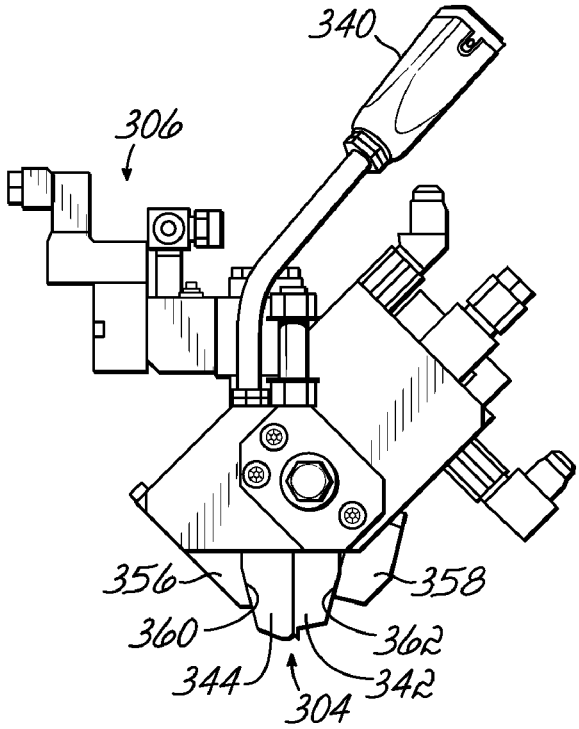
Figure 21:
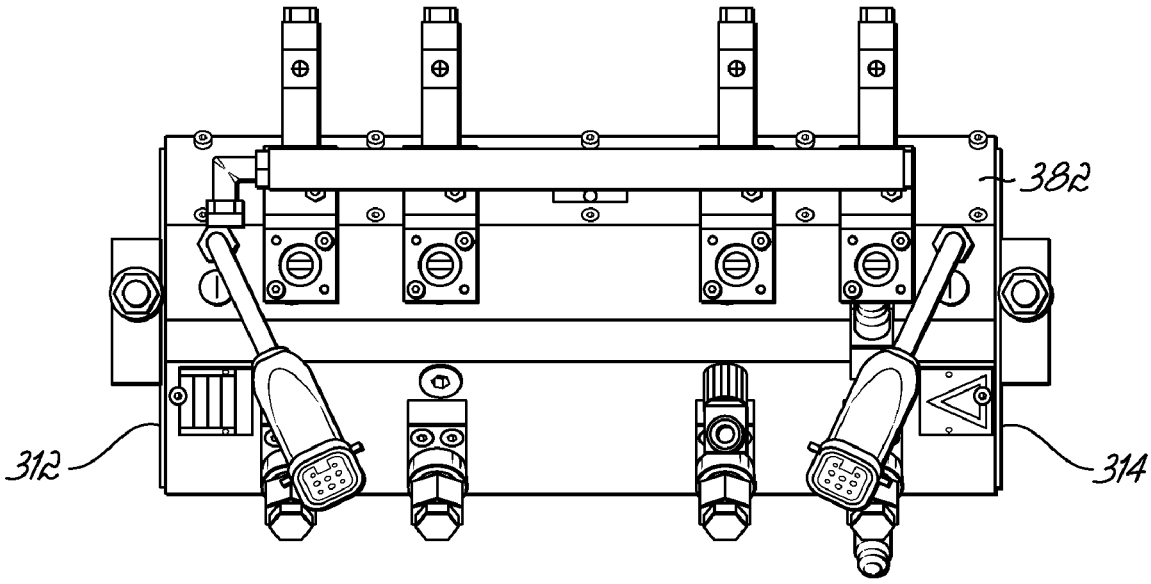

From the side view and top view of applicator device 301 according to FIGS. 19 and 21 a first and a second insulating board 312, 314 can be seen. Since the filters 320 are not inserted into the main body 302 at an end, they also do not pass through either of the insulating boards 312, 314.

Like the second embodiment, applicator device 301 of the third embodiment also has five fastening elements 358, which are however at different intervals from each other. In applicator device 301 there are two main electrical connections 340 present.

Figure 22:
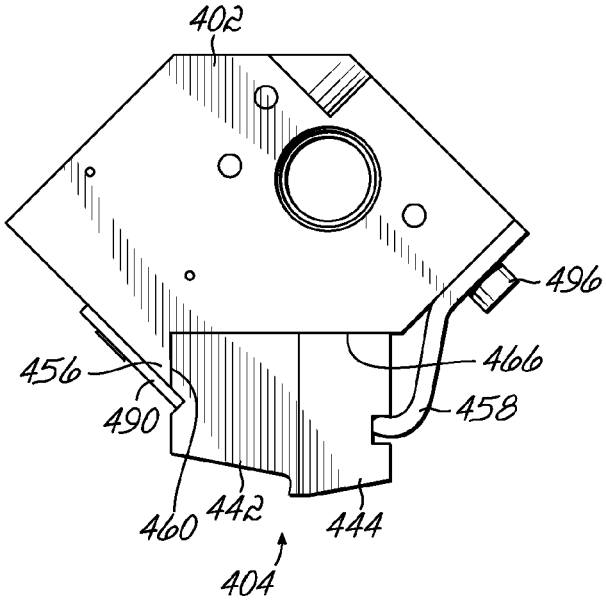
FIG. 22 is a side view of an applicator device according to a fourth embodiment.

The main body 402 according to the fourth embodiment and according to FIG. 22 has a contact surface 466 and a fixed clamping section 456 with a clamping section surface 460. Contact surface 466 and clamping section surface 460 are situated approximately at right angles to each other. Nozzle assembly 404 is attached to main body 402 by a holding element 490 in the form of a flat bar and an elastic clamping means 458 in the form of a sheet-metal spring. Holding element 490 and sheet-metal spring 458 both mesh with grooves 492 and 494 respectively, in nozzle assembly 404. Groove 492, into which holding element 490 meshes, is formed in nozzle adapter 442. Groove 494, into which sheet-metal spring 458 meshes, is formed in nozzle 444.

Sheet metal spring 458 depicted in FIG. 22 is under tension, which is achieved by sheet-metal spring 458 being screwed tightly against main body 402 in the area of sheet-metal spring attaching screw 496. When this sheet-metal spring attaching screw 496 is loosened, because of the tension sheet-metal screw 458 also is loosened from main body 402 initially in the area facing nozzle assembly 404, until sheet-metal spring 458 is relaxed. The concrete design of sheet-metal spring 458 in terms of material, shape, size and thickness thus predetermines the tensioning force and hence the holding force that develops when the sheet-metal spring is screwed flat against main body 402, as shown in FIG. 22. A torque wrench is therefore not required to attach nozzle assembly 404 with a predetermined strength.

Figure 23:
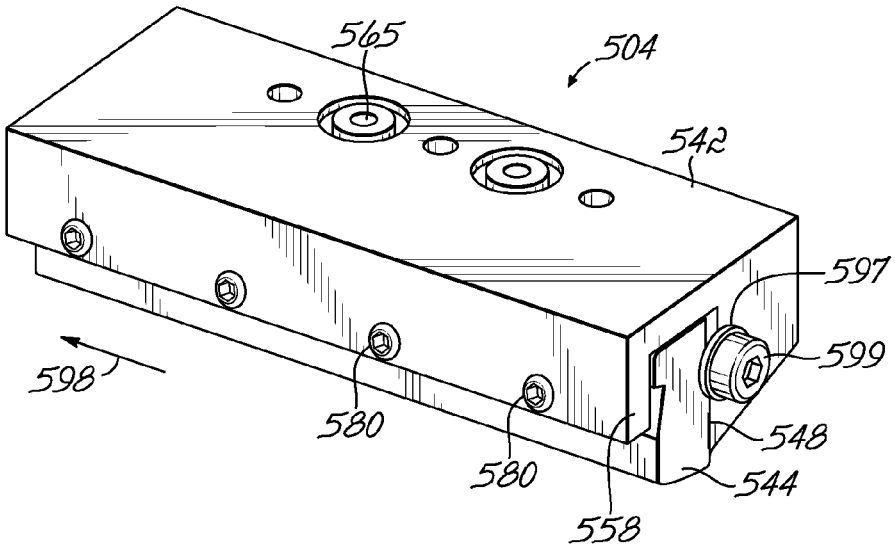
FIG. 23 is a perspective view of a nozzle assembly according to a fifth embodiment of the invention.

Nozzle assembly 504 according to a fifth embodiment and according to FIG. 23 has a nozzle 544 and a nozzle receptacle 542. Feed openings 565 for supplying hot melt adhesive are situated in nozzle receptacle 542. Nozzle 544 is surrounded by receptacle 542 approximately in a U-shape. Nozzle 544 can be pushed out of receptacle 542 in a pushing direction 598 when in the loosened state. A washer 597 together with a stop screw 599 forms a stop for nozzle 544 in the direction opposite the pushing direction 598. This enables nozzle 544 to be positioned in nozzle receptacle 542.

To fasten it, four clamping screws 580 are situated in one side 558 of nozzle receptacle 542. To clamp nozzle 544 tightly in nozzle receptacle 542, the tensioning screws 580 are screwed against nozzle 544. That forces nozzle 544 against nozzle receptacle 542, with a spacer plate 548 being clamped tightly between nozzle and nozzle receptacle 544, 542.

Figure 24:
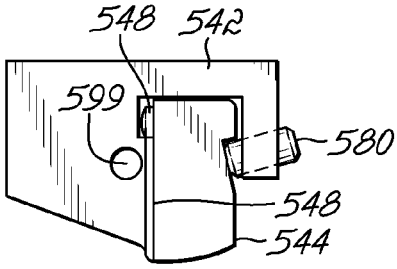
FIG. 24 is an end view the nozzle assembly according to FIG. 23.

As FIG. 24 makes clear, spacer plate 548 is fixed in position by locating pins 549. The locating points 549 are inserted into nozzle 544.

What is claimed is:

1. Applicator device for sheet application of liquid material comprising:

a main body including a fixed clamping section, a nozzle assembly including a nozzle, a nozzle adaptor, and a dispensing slot between said nozzle and said nozzle adaptor for dispensing the liquid material, and a clamping device including a clamping element and an attachment screw, said clamping element engaging said main body and being spaced from said fixed clamping section of said main body, said attachment screw being coupled to said main body and movable between a tightened position wherein said clamping element and said fixed clamping section force said nozzle assembly into engagement with said main body and a loosened position wherein said nozzle assembly may be removed from said main body without disengaging said clamping element from said main body.

2. Applicator device according to claim 1, wherein said clamping device has a plurality of clamping elements spaced apart from each other.

3. Applicator device according to claim 1, wherein said main body has a contact surface for engaging said nozzle assembly, said fixed clamping section has a clamping section surface, and said contact surface is oriented relative to said clamping section surface at an angle of less than 90°.

4. Applicator device according to claim 1, wherein said clamping device has at least one tensioning member adapted to clamp said nozzle assembly in position.

5. Applicator device according to claim 4, wherein said tensioning member includes at least one tensioning screw threadably engaged with said clamping element.

6. Applicator device according to claim 1, further comprising:

at least one positioning member configured to accurately position said nozzle assembly.

7. Applicator device according to claim 6, wherein said positioning member includes a stop for said nozzle assembly.

8. Applicator device according to claim 6, wherein said nozzle assembly includes a recess and said positioning member includes at least one corresponding element to engage said recess.

9. Applicator device according to claim 8, wherein said corresponding element is a threaded pin threadably engaged with said clamping element.

10. Applicator device according to claim 8, wherein said recess is generally conical.

11. Applicator device according to claim 1, wherein said clamping device has a first surface and said fixed clamping section of said main body has a second surface disposed in an opposing relationship with said first surface, said nozzle assembly received between said first and second surfaces.

12. Applicator device for sheet application of liquid material comprising:

a main body, a nozzle assembly including at least one slotted application nozzle for dispensing the liquid material, a clamping device attaching said nozzle assembly to said main body, and a heating device including a plurality of heating elements in said main body, at least two of which differ in heating capacity, said heating device operable to maintain a generally constant temperature profile of the liquid material in said at least one slotted application nozzle.

13. Applicator device according to claim 12, wherein at least one heating element in an outer zone of said main body has greater heating capacity than at least one heating element in an inner zone of said main body.

14. Applicator device according to claim 13, wherein the heating capacity of a heating element in the outer zone is higher than that of a heating element in the inner zone 60-100%.

15. Applicator device according to claim 12, further comprising at least one insulating board for thermally insulating said main body.

16. Applicator device according to claim 12, wherein said main body includes first and second end faces, and the applicator device further comprises at least one insulating board engaging each of said first and second end faces.

17. Applicator device for sheet application of liquid material comprising:

a main body, a nozzle assembly including at least one slotted application nozzle for dispensing the liquid material and a nozzle adaptor configured to hold said nozzle, a clamping device attaching said nozzle assembly to said main body, a spacer plate configured to form a dispensing slit between said nozzle and said nozzle adaptor, and a locating pin configured to fix said spacer plate in said nozzle assembly.

* * * * *

UNITED STATES PATENT AND TRADEMARK OFFICE

CERTIFICATE OF CORRECTION

PATENT NO. : 7,699,243 B2
APPLICATION NO. : 11/872317
DATED : April 20, 2010
INVENTOR(S) : Bernward Starke It is certified that error appears in the above-identified patent and that said Letters Patent is hereby corrected as shown below:

Column 13

Claim 14, line 4, change "60-100%" to --by 60-100%--.

Signed and Sealed this
Twenty-eighth Day of June, 2011

David J. Kappos

David J. Kappos
*Director of the United States Patent and Trademark Office*